US009145007B1

(12) United States Patent
Piatt et al.

(10) Patent No.: US 9,145,007 B1
(45) Date of Patent: Sep. 29, 2015

(54) DUPLEX PRINTER WITH PRINT BELTS FOR SHEET AND WEB PRINTING

(71) Applicants: Michael J. Piatt, Dayton, OH (US); Randy D. Vandagriff, Xenia, OH (US)

(72) Inventors: Michael J. Piatt, Dayton, OH (US); Randy D. Vandagriff, Xenia, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/541,290

(22) Filed: Nov. 14, 2014

(51) Int. Cl.

| | |
|---|---|
| ***B41J 2/01*** | (2006.01) |
| ***B41J 11/00*** | (2006.01) |
| ***B41J 3/60*** | (2006.01) |
| ***B41J 15/00*** | (2006.01) |
| ***B41J 13/00*** | (2006.01) |

(52) U.S. Cl.
CPC .. *B41J 11/00* (2013.01); *B41J 3/60* (2013.01); *B41J 13/00* (2013.01); *B41J 15/00* (2013.01)

(58) Field of Classification Search
CPC ..... B41J 11/00; B41J 13/00; B41J 15/00; B41J 3/60; B41J 13/0009; B41J 13/226
See application file for complete search history.

(56) References Cited

U.S. PATENT DOCUMENTS

| | | | | |
|---|---|---|---|---|
| 4,168,830 | A | 9/1979 | Hori et al. | |
| 4,225,872 | A | 9/1980 | Marinoff | |
| 4,237,466 | A | 12/1980 | Scranton | |
| 4,792,249 | A | 12/1988 | Lahr | |
| 5,816,722 | A * | 10/1998 | Fujiwara et al. | 400/605 |
| 6,477,950 | B1 | 11/2002 | Feilen et al. | |
| 2009/0148209 | A1 | 6/2009 | Ikegami | |
| 2009/0185844 | A1 | 7/2009 | Ikegami | |
| 2011/0134200 | A1 | 6/2011 | Ikegami | |
| 2013/0287465 | A1 | 10/2013 | Turner et al. | |
| 2014/0327724 | A1 * | 11/2014 | Sarbjit et al. | 347/104 |

FOREIGN PATENT DOCUMENTS

| | | |
|---|---|---|
| JP | 2003-63707 | 3/2003 |

* cited by examiner

*Primary Examiner* — Julian Huffman
(74) *Attorney, Agent, or Firm* — Kevin E. Spaudling

(57) ABSTRACT

A duplex printing system includes two printing stations, each having a print belt and a set of marking subsystems. In a sheet-printing mode, a media sheet is transported to the first printing station where the print belt is rotated to transport the sheet past the marking subsystems to print a first-side image. The sheet is then transported to the second printing station where the print belt is rotated to transport the sheet past the marking subsystems to print a second-side image. The sheet is then transported to an output sheet receptacle. In a web-printing mode the print belts are configured to rotate freely and a web of media is transported around the first print belt where a first-side image is printed, and from there around the second print belt where a second-side image is printed. A tensioning system is used to control the motion of the web of media.

24 Claims, 9 Drawing Sheets

DUPLEX PRINTER WITH PRINT BELTS FOR SHEET AND WEB PRINTING

CROSS-REFERENCE TO RELATED APPLICATIONS

Reference is made to commonly assigned, co-pending U.S. patent application Ser. No. 14/541,271, entitled: "Duplex printer for sheet and web printing", by M. Piatt et al.; and to commonly assigned, co-pending U.S. patent application Ser. No. 14/541,311, entitled: "Printer for sheet and web printing", by M. Piatt et al., each of which is incorporated herein by reference.

FIELD OF THE INVENTION

This invention pertains to the field of digital printing systems and more particularly to a printing system that can print on both sheets of media and webs of media.

BACKGROUND OF THE INVENTION

Digital printing systems offer many advantages such as providing short run printing capability with variable content in a cost effective manner. Digital printing systems have been developed using a variety of different technologies including inkjet printing systems and electrophotographic printing systems.

Inkjet printing is a non-contact application of an ink to a receiver medium. Typically, one of two types of inkjet mechanisms are used and are categorized by technology as either "drop on demand" inkjet or "continuous inkjet." The first inkjet technology, drop-on-demand inkjet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal inkjet."

The second inkjet technology, commonly referred to as continuous inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that print drops reach the receiver medium and non-print drops are caught by a collection mechanism. Various approaches for selectively deflecting drops have been developed including electrostatic deflection, air deflection, and thermal deflection.

Electrophotographic printing systems form an electrostatic latent image on a photoreceptor by uniformly charging the photoreceptor and then discharging selected areas of the uniform charge to yield an electrostatic charge pattern corresponding to the desired image (i.e., a "latent image"). After the latent image is formed, charged toner particles are brought into the vicinity of the photoreceptor and are attracted to the latent image to develop the latent image into a toner image. After the latent image is developed into a toner image on the photoreceptor, a receiver medium is brought into juxtaposition with the toner image. A suitable electric field is applied to transfer the toner particles of the toner image to the receiver medium to form the desired print image on the receiver medium. The receiver medium is then subjected to heat or pressure to permanently fix (i.e., "fuse") the print image to the receiver. Plural print images (e.g., separation images of different colors) can be overlaid on the receiver before fusing to form a multi-color print image on the receiver.

Some digital printing systems are adapted to print on continuous webs of receiver media, while others are adapted to print on cut sheets of receiver media. In web printing systems, a continuous web of receiver media is moved from a source roll through and travels along a web transport path past printing system components which deposit marking material to form printed images. In cut sheet printing systems, individual sheets of receiver media are moved along a sheet transport path past printing system components which deposit marking material to form printed images.

Web printing systems and cut sheet printing systems each have different advantages which are useful for various printing applications. However, equipment cost and space allocation make it difficult for companies to support both media formats. There is a need for a printing system that can be used to print on both continuous webs of receiver media as well as cut sheets of receiver media.

SUMMARY OF THE INVENTION

The present invention represents a duplex printing system for printing on sheets of media in a first printing mode and on a web of media in a second printing mode, comprising:

a first printing station including a first print belt and one or more first marking subsystems positioned to deposit a pattern of marking material on a first side of the media while a second side of the media is in contact with the first print belt, wherein the first print belt travels around a plurality of rollers in a continuous first belt path;

a selectively activatable first drive mechanism for moving the first print belt around the first belt path;

a second printing station including a second print belt and one or more second marking subsystems positioned to deposit a pattern of marking material on the second side of the media while the first side of the media is in contact with the second print belt, wherein the second print belt travels around a plurality of rollers in a continuous second belt path;

a selectively activatable second drive mechanism for moving the second print belt around the second belt path;

a tensioning system for driving and adding tension to the web of media; and a control system for controlling the first and second drive mechanisms and the tensioning system;

wherein when the duplex printing system is in the first printing mode sheets of media are transported along a sheet transport path such that:

the sheets of media are transported to the first print belt;

the control system controls the first drive mechanism to move the first print belt around the first belt path, thereby transporting the sheets of media past the one or more first marking subsystems to deposit a pattern of marking material on the first side of the sheets of media in accordance with image data;

the sheets of media are transported from the first print belt to the second print belt;

the control system controls the second drive mechanism to move the second print belt around the second belt path, thereby transporting the sheets of media past the one or more second marking subsystems to deposit a pattern of marking material on the second side of the sheets of media in accordance with image data; and the sheets of media are transported from the second print belt to an output of the duplex printing system; and when the duplex printing system is in the second printing mode the first and second drive mechanisms are deactivated so that the first and second print belts can move freely around their respective first and second belt paths, and the control system controls the tensioning system to transport the web of media along a web transport path such that:

the web of media travels to the first print belt;

the web of media passes around the first print belt with the second side of the web of media being in contact with the first print belt, thereby transporting the web of media past the one or more first marking subsystems to deposit a pattern of marking material on the first side of the web of media in accordance with image data;

the web of media travels from the first print belt to the second print belt;

the web of media passes around the second print belt with the first side of the web of media being in contact with the second print belt, thereby transporting the web of media past the one or more second marking subsystems to deposit a pattern of marking material on the second side of the web of media in accordance with image data; and the web of media travels from the second print belt to an output of the duplex printing system.

This invention has the advantage that the same printer mechanism can be used to print on either sheets of media or a web of media. This reduces the equipment cost and space allocation relative to a separate printing system for each format.

It has the additional advantage that the printing system can be easily and quickly reconfigured to operate in either the sheet-printing mode or the web-printing mode.

It has the further advantage that the printing system can print on both sides of the receiver media.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1A:
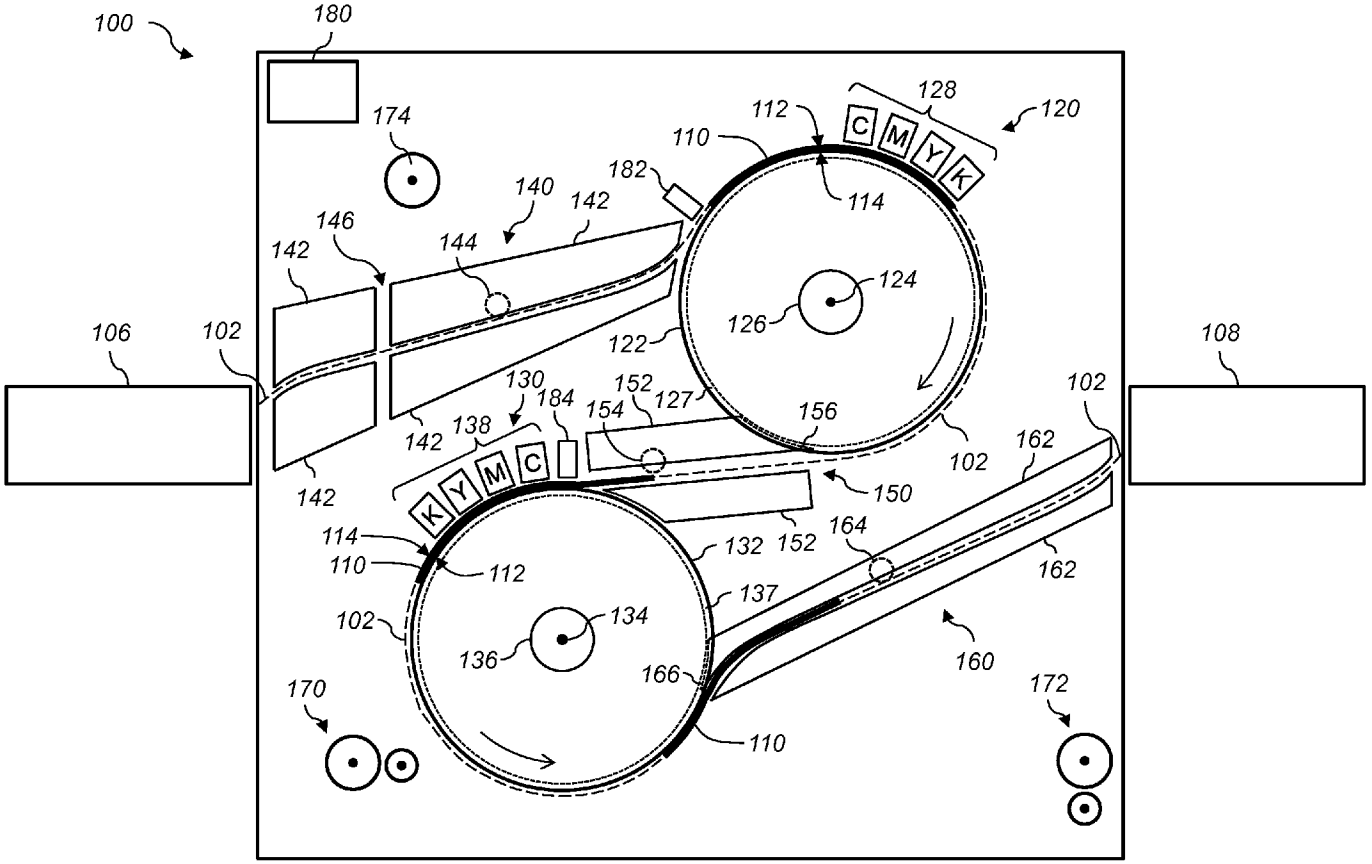
FIG. 1A is a schematic side view diagram showing a duplex printing system according to an exemplary embodiment being operated in a cut sheet printing mode.
Figure 1B:
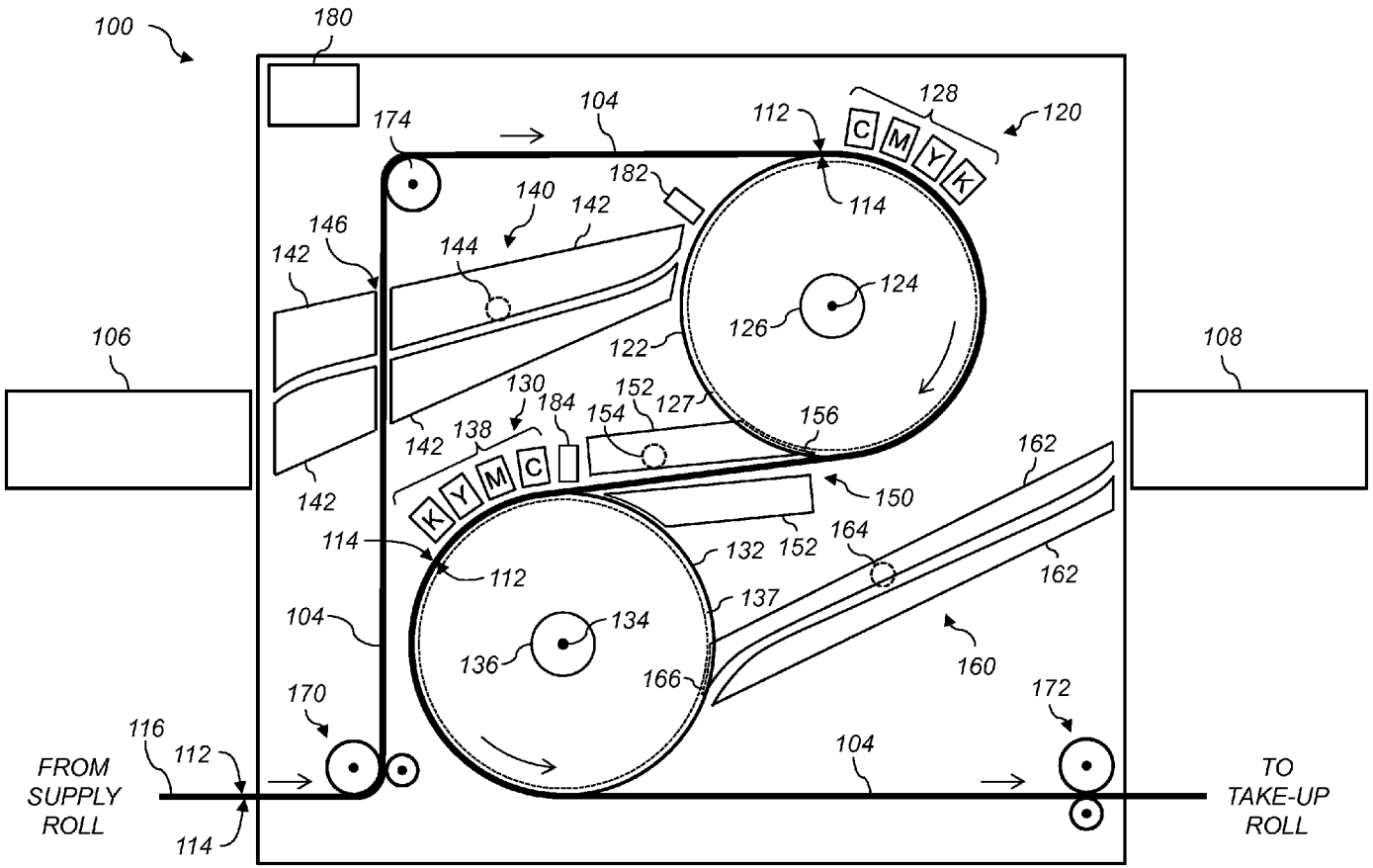
FIG. 1B is a schematic side view diagram showing the duplex printing system of FIG. 1A being operated in a web printing mode.

FIGS. 1A-1B illustrate an exemplary embodiment of a duplex printing system 100. In FIG. 1A, the printing system 100 is shown operating in a first sheet-printing mode for printing on cut sheets of media 110. In FIG. 1B, the printing system 100 is shown operating in a second web-printing mode for printing on a web of media 116. When the printing system 100 is operating in the web-printing mode, the web of media 116 travels along a web transport path 104 which does not interfere with the components used in the sheet-printing mode and when the printing system 100 is operating in the sheet-printing mode, the sheets of media 110 travel along a sheet transport path 102 which does not interfere with the components used in the web-printing mode.

The printing system 100 includes a first printing station 120 for printing on a first side of the media and a second printing station 130 for printing in a second side 114 of the media. The first printing station 120 includes a first print drum 122, and a set of first marking subsystems 128 positioned to deposit a pattern of marking material on the first side 112 of the media according to first-side image content while the second side 114 of the media is in contact with the first print drum 122. Similarly, the second printing station 130 includes a second print drum 132, and a set of second marking subsystems 138 positioned to deposit a pattern of marking material on the second side 114 of the media according to second-side image content while the first side 112 of the media is in contact with the second print drum 132. One skilled in the art will recognize that other processes such as applying a protective coating or drying may also be staged around the circumference of the print drums 122, 132.

In the illustrated embodiment, the marking subsystems 128, 138 are used to apply cyan (C), magenta (M), yellow (Y) and black (K) marking materials. In other embodiments, the marking subsystems 128, 138 can apply a different set of marking materials which can include different colors of marking materials or colorless marking materials.

In an exemplary embodiment, the marking subsystems 128, 138 are inkjet printheads adapted to apply drops of ink to the receiver media. The inkjet printheads can be drop-on-demand inkjet printheads or continuous inkjet printheads. Both types of printheads will be well-known to those skilled in the art. In other embodiments, the marking subsystems 128, 138 can utilize other types of printing technology such as electrophotographic printing or thermal dye sublimation printing.

A first selectively activatable first drive mechanism 126 is used to drive the first print drum 122 to rotate around a corresponding axis 124, and a second selectively activatable first drive mechanism 136 is used to drive the second print drum 132 to rotate around a corresponding axis 134. Within the context of the present disclosure, the term "selectively activatable" should be taken to mean that the drive mechanism can be turned off and on at different times according to an appropriate control mechanism. The control mechanism can be either automatic or manual. The drive mechanisms 126, 136 can be coupled to the corresponding print drums 122, 132 using any method known in the art, such as a gear train, a clutch, or a direct drive mechanism. When the drive mechanisms 126, 136 are deactivated, the motors are preferably powered off and decoupled from the corresponding print drums 122, 132. For cases where gear trains are used to couple the motors to the print drums 122, 132, a gear in the gear train can be repositioned to disengage its teeth from the teeth of an adjacent gear, for example by shifting the gear in an axial direction, or by translating the axis of the gear using a cam mechanism. In some embodiments, the gear can be repositioned using an automatic control mechanism. In other embodiments, an operator can perform a manual operation to reposition the gear to reconfigure the printing system 100 according to use a different type of media (i.e., sheets of media 110 or a web of media 116).

When the printing system 100 is operated in the first sheet-printing mode, a series of components are used to move sheets of media 110 along a sheet transport path 102 as illustrated in FIG. 1A.

An input sheet feeder 106 is provided to supply sheets of media 110 to the printing system 100. A wide variety of different mechanisms for input sheet feeders 106 are known in the art, and any such mechanism can be used in accordance with the present invention.

An output sheet receptacle 108 is provided to receive sheets of media 110 that have been printed using the printing system 100. A wide variety of different mechanisms for output sheet receptacles 108 are known in the art, and any such mechanism can be used in accordance with the present invention. In an exemplary embodiment, the output sheet receptacle 108 is a sheet stacker which stacks the sheets of media 110 in a stack. In various embodiments, the output sheet receptacle 108 can include various finishing mechanisms such as collating mechanisms or stapling mechanisms.

An input sheet transport mechanism 140 is provided for transporting sheets of media 110 from the input sheet feeder 106 to the print drum 122. In the illustrated embodiment, the input sheet transport mechanism 140 includes a set of passive sheet guides 142 which guide the sheets of media 110 along sheet transport path 102. The input sheet transport mechanism 140 optionally includes a motorized drive mechanism, such as drive roller 144, for actively moving the sheets of media 110 along the sheet transport path 102. A slot 146 is provided through input sheet transport mechanism 140 which enables the web of media 116 to pass through the input sheet transport mechanism 140 as it travels along the web transport path 104 (see FIG. 1B).

An intermediate sheet transport mechanism 150 is adapted to transport the sheets of media 110 from the first print drum 122 to the second print drum 132. In the illustrated embodiment, the intermediate sheet transport mechanism 150 includes a pair of passive sheet guides 152 and a motorized drive roller 154 for moving the sheets of media 110 along the sheet transport path 102.

An output sheet transport mechanism 160 is adapted to transport the sheets of media 110 from the second print drum 132 to the output sheet receptacle 108. In the illustrated embodiment, the output sheet transport mechanism 160 includes a pair of passive sheet guides 162 and a motorized drive roller 164 for moving the sheets of media 110 along the sheet transport path 102.

Preferably, sheet stripping mechanisms are provided to strip the sheets of media 110 away from the surface of the print drums 122, 132 to direct them along the sheet transport path 102. Any appropriate type of sheet stripping mechanism known in the art can be used in accordance with the present invention. In the illustrated embodiment, the upper sheet guide 152 in the intermediate sheet transport mechanism 150 includes a set of fingers 156 that extend into grooves 127 formed around the surface of the first print drum 122. (The fingers 156 and the grooves 127 are further illustrated in FIG. 2.) As a sheet of media 110 is carried along the sheet transport path 102 by the first print drum 122, the fingers 156 will lift the leading edge of the sheet of media 110 away from the surface of the print drum 122, and will direct the sheet of media 110 between the sheet guides 152 of the intermediate sheet transport mechanism 150. Additional details about the use of stripper finger arrangements can be found in U.S. Pat. No. 4,225,872 to Marinoff, entitled "Ink jet printer," and U.S. Pat. No. 4,237,466 to Scranton, entitled "Paper transport system for an ink jet printer," each of which are incorporated herein by reference.

Similarly, the upper sheet guide 162 in the output sheet transport mechanism 160 includes a set of fingers 166 that extend into grooves 137 formed around the surface of the second print drum 132. As a sheet of media 110 is carried along the sheet transport path 102 by the second print drum 132, the fingers 166 will lift the leading edge of the sheet of media 110 away from the surface of the print drum 132, and will direct the sheet of media 110 between the sheet guides 162 of the output sheet transport mechanism 160.

In alternate embodiments, other types of sheet stripping mechanisms can be used. For example, air knives can be directed to lift the sheets of media 110 away from the surface of the print drums 122, 132. An example of an air knife configuration that can be used in accordance with the present invention is described in U.S. Pat. No. 4,168,830 to Hori et al., entitled "Air jet paper pick-off for liquid developer electrostatic copier."

When the printing system 100 is operated in the second web-printing mode, a series of components are used to move the web of media 116 along a web transport path 104 as illustrated in FIG. 1B. A tensioning system is used for driving and adding tension to the web of media 116. In the illustrated embodiment, the tensioning system includes tensioning rollers 170, 172. The web of media 116 is supplied by a supply roll (not shown) and passes between the first set of tensioning rollers 170, which adds tension to the web of media 116 and redirects it in a vertical direction. The web of media 116 then passes around an encoder roller 174 which redirects it toward the first print drum 122. After passing around the first print drum 122, the web of media travels to the second print drum 132. The web of media 116 then passes through the second set of tensioning rollers 172 and is received by a take-up roll or appropriate finishing components (not shown).

In a preferred embodiment, the web of media 116 passes through the intermediate sheet transport mechanism 150 without touching any of its components (e.g., the sheet guides 152 and the drive roller 154). In an exemplary embodiment, the drive roller 154 is repositionable so that it can be moved away from the web transport path 104 as shown in FIG. 1B so that it does not touch the web of media 116 when the printing system 100 is being operated in the web-printing mode.

A control system 180 is provided to control the components of the printing system 100, including the drive mechanisms 126, 136 associated with the print drums 122, 132 and the components of the tensioning system. The control system 180 includes one or more data processing devices that control the components of the printing system 100 to implement the processes associated with the various embodiments of the present invention, including the example processes described herein. The phrase "data processing device" is intended to include any data processing device, such as a central processing unit ("CPU"), a microprocessor, a desktop computer, a laptop computer, a mainframe computer, or any other device for processing data, managing data, or handling data or providing control signal data, whether implemented with electrical, magnetic, optical, biological components, or otherwise.

Among other things, the control system 180 can control the drive mechanisms 126, 136 to rotate the print drums 122, 132. The control system 180 also controls the components of the tensioning system (e.g., the tensioning rollers 170, 172) to control the amount of tension in the web of media 116, and the velocity that the web of media 116 travels through the printing system 100. The control system 180 also controls the marking subsystems 128, 138 to control the pattern of marking material deposited on the media in accordance with image data. The control system 180 also controls other active components such as the input sheet feeder 106, the output sheet receptacle 108 and the drive rollers 144, 154, 164.

The printing system also includes one or more position encoder subsystems that provide encoder signals providing an indication of the position of the sheets of media 110 as they travel along the sheet transport path 102 or the web of media 116 as it travels along the web transport path 104. The encoder signals can be used to control a timing that the marking subsystems 128, 138 deposit the pattern of marking material on the media. In the illustrated the embodiment, media edge detectors 182, 184 are positioned at appropriate locations to detect when a leading edge of the sheets of media 110 as they pass by. This enables an accurate prediction of when the sheets of media 110 will pass by the marking subsystems 128, 138 so that the pattern of marking material can be deposited at the desired locations.

In the illustrated embodiment, the encoder roller 174 serves the role of the position encoder subsystem in the web-printing mode. In a preferred embodiment, the encoder roller 174 is a passive roller that provides an encoder pulse when the encoder roller 174 rotates by a specified angle. This enables an accurate estimation of the velocity that the web of media 116 is moving, and the overall distance that the web of media 116 moves relative to the position at a reference time. It is generally desirable that the resolution (i.e., the encoder pulses per inch of media movement) of the encoder signal provided by the encoder roller 174 be higher than the printing resolution (i.e., the pixels per inch) of the marking subsystems 128, 138 in order to accurately control the registration of the printing process. The encoder signal from the encoder roller 174 can also be used to control the tensioning rollers 170, 172 in order to maintain the motion of the web of media 116 at a desired constant velocity.

The operation of the printing system 100 in the two printing modes will now be described. When the printing system 100 is operating in the first sheet-printing mode, sheets of media 110 are transported through the printing system 100 along the sheet transport path 102. The sheets of media 110 are supplied from the input sheet feeder 106 and are carried by the input sheet transport mechanism 140 to the first print drum 122. Typically, the input sheet feeder 106 will include a media picking mechanism (not shown) which picks the top sheet of media 110 from a stack and pushes it into input sheet transport mechanism 140.

In the illustrated embodiment, the drive roller 144 in the input sheet transport mechanism 140 pushes the sheet of media 110 through the input sheet transport mechanism 140 and propels it until the sheet of media 110 reaches the print drum 122. Preferably, the drive roller 144 should accelerate the sheet of media 110 so that the velocity of the sheet of media 110 matches the tangential velocity of the surface of the print drum 122 when the leading edge sheet of media 110 reaches the print drum 122.

In the sheet-printing mode, the control system 180 controls the drive mechanism 126 associated with the print drum 122 to rotate the print drum 122, thereby transporting the sheets of media 110 past the first marking subsystems 128. At this point along the sheet transport path 102, the sheets of media 110 will be oriented so that the second side 114 contacts the print drum 122 and the first side 112 faces the marking subsystems 128. This enables the marking subsystems 128 to print the image content on the first side 112 of the media in accordance with image data provided to the printing system 100. In an exemplary embodiment, the timing that the marking subsystems 128 deposit marking material onto the sheet of media 110 is controlled responsive to a signal from the media edge detector 182, which determines a position of the sheet of media 110 on the print drum 122.

Figure 2:
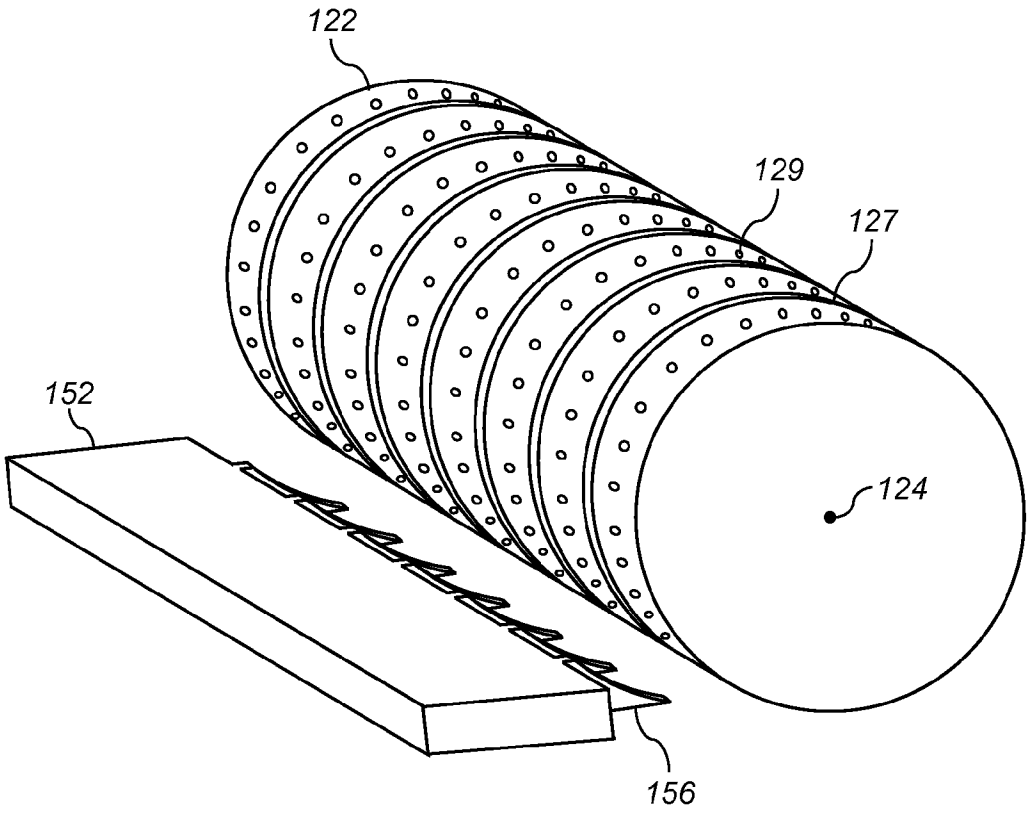
FIG. 2 is a perspective diagram showing a drum and a passive sheet guide including sheet stripping fingers.

Generally, the print drum 122 will include a holding subsystem to hold the sheets of media 110 firmly onto the print drum 122 as they are transported past the marking subsystems 128. Any appropriate holding mechanism known in the art can be used in accordance with the present invention. Examples of such holding mechanisms would include vacuum holding mechanisms, electrostatic holding mechanisms, or mechanical clamping holding mechanisms. FIG. 2 shows an example of a print drum 122 which includes a pattern of vacuum holes 129 to provide a vacuum holding mechanism. A vacuum pump (not shown) can be used to create a vacuum in an interior chamber within the print drum 122, thereby providing a vacuum force through the vacuum holes 129 to hold the sheet of media 110 (FIG. 1A) to the surface of the print drum 122.

Electrostatic holding mechanisms for holding a sheet of media 110 to a surface (e.g., a belt or a drum) are well-known in the art. In such systems, a charging subsystem (e.g., a corona charger) is used to provide a charge on the sheet of media 110 or the surface (or both) to provide an electrostatic holding force. In some configurations, the sheet of media 110 can later be provided with an opposite charge so that it can be removed (or "detacked") from the surface.

In some embodiments a control mechanism can be provided to activate and deactivate the holding mechanisms. The control mechanism can either be passive or active (e.g., controlled by the control system 180). Examples of active control mechanisms would include controlling a valve to turn a vacuum force off and on, or to reverse the air flow so that air is pushed out through at least some of the vacuum holes 129 rather than being pulled in through the vacuum holes 129, or adjusting a voltage to control an electrostatic holding force. In some embodiments, the deactivation of the holding mechanism can also provide the function of a sheet stripping mechanism. For example, if the air flow is reversed to push air out through the vacuum holes 129, this will effectively "strip" the sheet of media 110 away from the surface of the print drum 122.

An example of a passive control mechanism would be positioning an internal blockage mechanism within the print drum 122 to block a subset of the vacuum holes 129 at positions around the print drum 122 where it is desired to release the sheet of media 110 from being held to the print drum 122 (e.g., near the "six o'clock" position). For example, as the print drum 122 rotates to carry the sheet of media 110 toward the intermediate sheet transport mechanism 150, the vacuum holes near the input to the intermediate sheet transport mechanism 150 can be blocked so that the fingers 156 can more easily lift the leading edge of the sheet of media 110 away from the print drum 122 to direct it into the intermediate sheet transport mechanism 150. Suction would continue to be provided through vacuum holes 129 located at other positions around the print drum 122 (e.g., between the "ten o'clock" and "six o'clock" positions) in order to hold sheets 110 between the entry point from input sheet transport mechanism 140 and the exit point to intermediate sheet transport mechanism 150.

In some embodiments, a first holding mechanism associated with the first print drum 122 can be activated while a particular sheet of media 110 is received from the input sheet transport mechanism 140 and is being transported past the first marking subsystems 128. The first holding mechanism is then deactivated to release the particular sheet of media 110 from being held to the print drum 122 in synchronization with activating a second holding mechanism associated with the second print drum 132. The second holding mechanism remains activated while the particular sheet of media 110 is transported past the second marking subsystems 138, and is then deactivated to release the particular sheet of media 110 from being held to the print drum 132 and direct it into the output sheet transport mechanism 160. It should be understood that the terminology "in synchronization with" does not necessarily imply that the deactivation of the first holding mechanism happens simultaneously with the activation of the second holding mechanism. In some embodiments, the first holding mechanism can be deactivated either before or after the second holding mechanism activated (e.g., according to a predefined time interval) in order to provide the desired control for the movement of the sheet of media 110. The drive rollers 144, 154, 164 can also be controlled in synchronization with the activation and deactivation of the first and second holding mechanisms to provide smooth transitions of the sheets of media from one component to the next along the sheet transport path 102.

Figure 3:
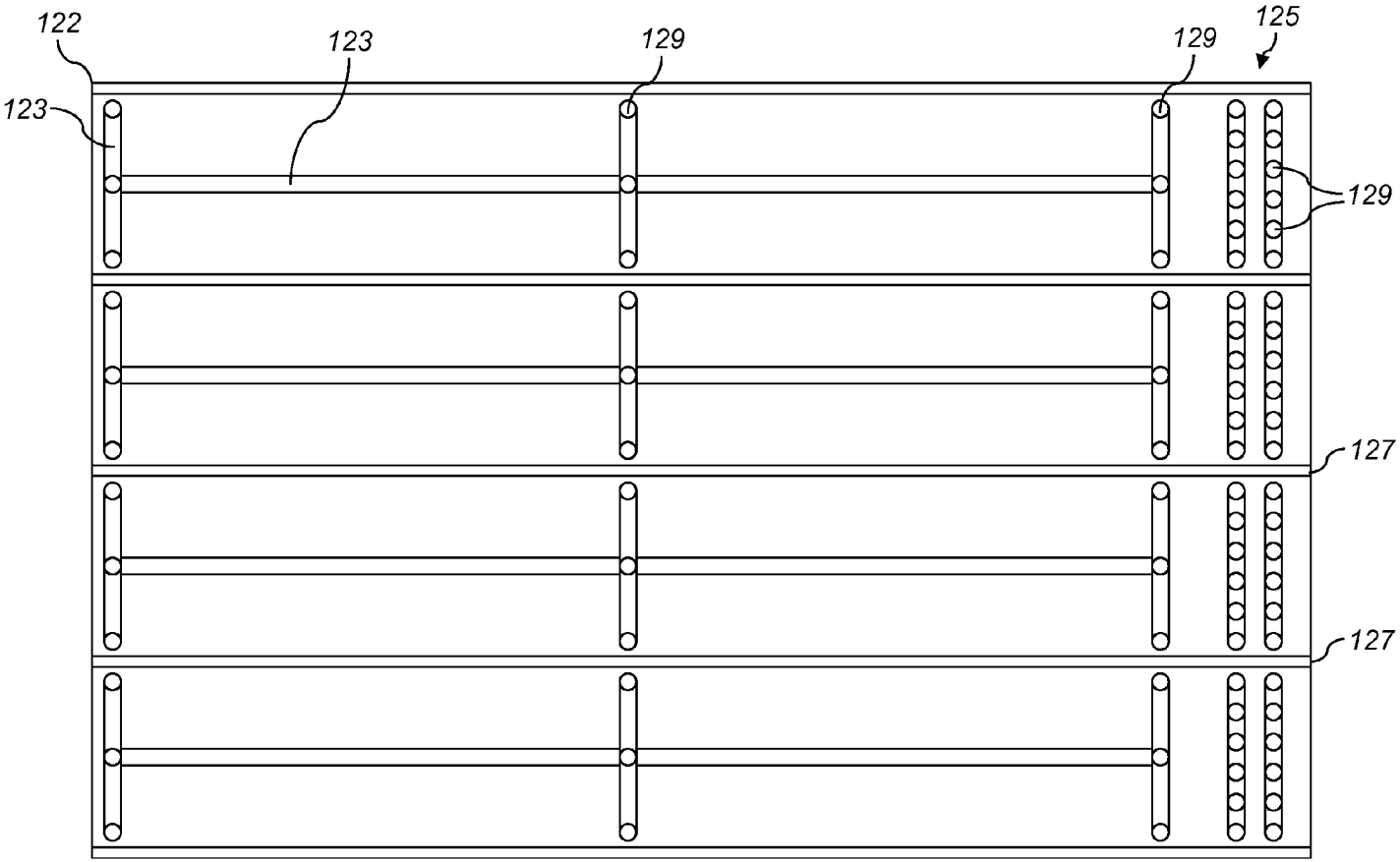
FIG. 3 shows a top view a drum surface that includes vacuum holes and grooves.

In the example of FIG. 2, the vacuum holes 129 are uniformly distributed around the surface of the print drum 122. FIG. 3 shows a top view of the surface of the print drum 122 according to an alternate configuration where the vacuum holes 129 are arranged in a non-uniform pattern. A larger concentration of vacuum holes 129 is provided in a leading edge region 125 to provide a larger holding force in that region. This can enable the sheet of media 110 to be more reliably picked up as it passes from the input sheet transport mechanism 140 onto the print drum 122. Furthermore, some of the vacuum holes 129 are connected by channels 123. As the fingers 156 (FIG. 1A) lift the leading edge of the sheet of media 110 away from the surface of the print drum 122, this allows air to flow into the channels 123, thereby relieving the vacuum force provided by the vacuum holes 129 within the channels 123, releasing the sheet of media 110 from being held to the surface of the print drum 122.

After the first printing station 120 has printed the image data on the first side 112 of the sheet of media 110, it is directed into the intermediate sheet transport mechanism 150, which transports the sheet of media 110 to the second print drum 132. In the illustrated embodiment, the drive roller 154 in the intermediate sheet transport mechanism 150 pushes the sheet of media 110 through the intermediate sheet transport mechanism 150 and propels it until the sheet of media 110 reaches the second print drum 132. Preferably, the drive roller 154 should control the motion of the sheet of media 110 so that the velocity of the sheet of media 110 matches the tangential velocity of the surface of the print drum 132 when the leading edge sheet of media 110 reaches the print drum 132.

In the sheet-printing mode, the control system 180 activates the drive mechanism 136 associated with the print drum 132 to rotate the print drum 132, thereby transporting the sheets of media 110 past the second marking subsystems 138. At this point along the sheet transport path 102, the sheets of media 110 will be oriented so that the first side 112 contacts the print drum 122 and the second side 114 faces the marking subsystems 138. This enables the marking subsystems 138 to print the image content on the second side 114 of the media in accordance with image data provided to the printing system 100. In an exemplary embodiment, the timing that the marking subsystems 138 deposit marking material onto the sheet of media 110 is controlled responsive to a signal from the media edge detector 184, which determines a position of the sheet of media 110 on the print drum 132.

Generally, the print drum 132 will include a holding subsystem to hold the sheets of media 110 firmly onto the print drum 132 which is controlled in a manner analogous to the holding subsystem associated with the print drum 122, which was described previously.

After the second printing station 130 has printed the image data on the second side 114 of the sheet of media 110, it is directed into the output sheet transport mechanism 160, which transports the sheet of media 110 to the output sheet receptacle 108. In the illustrated embodiment, the drive roller 164 in the output sheet transport mechanism 160 pushes the sheet of media 110 through the output sheet transport mechanism 160 and propels it until the sheet of media 110 reaches the output sheet receptacle 108. The sheet of media 110 is typically deposited on top of a stack of previously printed sheets of media 110 in the output sheet receptacle 108. However in various embodiments, the sheets of media 110 can be arranged in any appropriate arrangement in the output sheet receptacle 108 in order to prepare it for delivery to the customer, or for any subsequent finishing operations which are to be performed.

The printing system 100 can also be configured to operate in a second web-printing mode to print on a web of media 116 as illustrated in FIG. 1B. In this mode, the web of media 116 is threaded through the printing system 100 to travel along a web transport path 104. To switch the printing system 100 from the sheet-printing mode to the web-printing mode, it is generally necessary to make a number of adjustments to the printer components. In particular, the drive mechanisms 126, 136 associated with the first and second print drums 122, 132 should be deactivated so that the print drums 122, 132 can rotate freely. As was discussed earlier, this typically involves turning off motors and making either manual or automatic adjustments to decouple the motors from the print drums 122, 132 (e.g., by repositioning a gear or a clutch mechanism).

In the web-printing mode, the control system 180 controls the tensioning system to transport the web of media 116 along the web transport path 104 at a controlled tension and velocity. In an exemplary embodiment, this can be done by controlling the speed of servo-driven motors used to drive the tensioning rollers 170, 172. In some configurations, the tensioning rollers 172 can be controlled to rotate at a slightly higher speed than the tensioning rollers 170 to control the tension in the web of media 116. It will generally be desirable for the control system 180 to deactivate the tensioning rollers 170, 172 when the printing system 100 is being operated in the sheet-printing mode to conserve energy and reduce component wear.

In the web-printing mode, the web transport path 104 carries the web of media 116 from a supply roll (not shown) into the printing system 100 and through the first set of tensioning rollers 170. The web of media 116 then travels upward through a slot 146 in the input sheet transport mechanism 140 and passes around the encoder roller 174. From there it travels to the first print drum 122 with the second side 114 of the web of media 116 being in contact with the surface of the print drum 122.

As the web of media 116 travels around the print drum 122, the marking subsystems 128 deposit marking material to print the image content on the first side 112 of the web of media 116 in accordance with image data provided to the printing system 100. In an exemplary embodiment, the timing that the marking subsystems 128 deposit marking material onto the web of media 116 is controlled responsive to a signal from the encoder roller 174, which characterizes the movement and position of the web of media 116.

The web of media 116 then travels from the first print drum 122 to the second print drum 132, typically passing through the intermediate sheet transport mechanism 150. Preferably, the web transport path 104 carries the web of media 116 through the intermediate sheet transport mechanism 150 without it contacting any of the associated components. This may require that the drive roller 154 be repositioned to move it away from the web transport path 104. In some embodiments, it may also be necessary to reposition one or more of the sheet guides so that they do not interfere with the web transport path 104.

As the web of media 116 travels around the print drum 132, the first side 112 of the web of media 116 contacts the surface of the print drum 132, and the marking subsystems 138 are controlled to deposit marking material to print the image content on the second side 114 of the web of media 116 in accordance with image data provided to the printing system 100. In an exemplary embodiment, the timing that the marking subsystems 138 deposit marking material onto the web of media 116 is controlled responsive to a signal from the encoder roller 174, which characterizes the movement and position of the web of media 116.

The web of media 116 then travels from the second print drum 132 through the second set of tensioning rollers 172. From there, the web of media 116 typically travels to a take-up roll (not shown). In some embodiments, the web of media 116 can travel to various finishing components which can perform operations such as slitting, cutting, folding and binding the media to deliver the printed image into a format requested by the customer.

Figure 4:
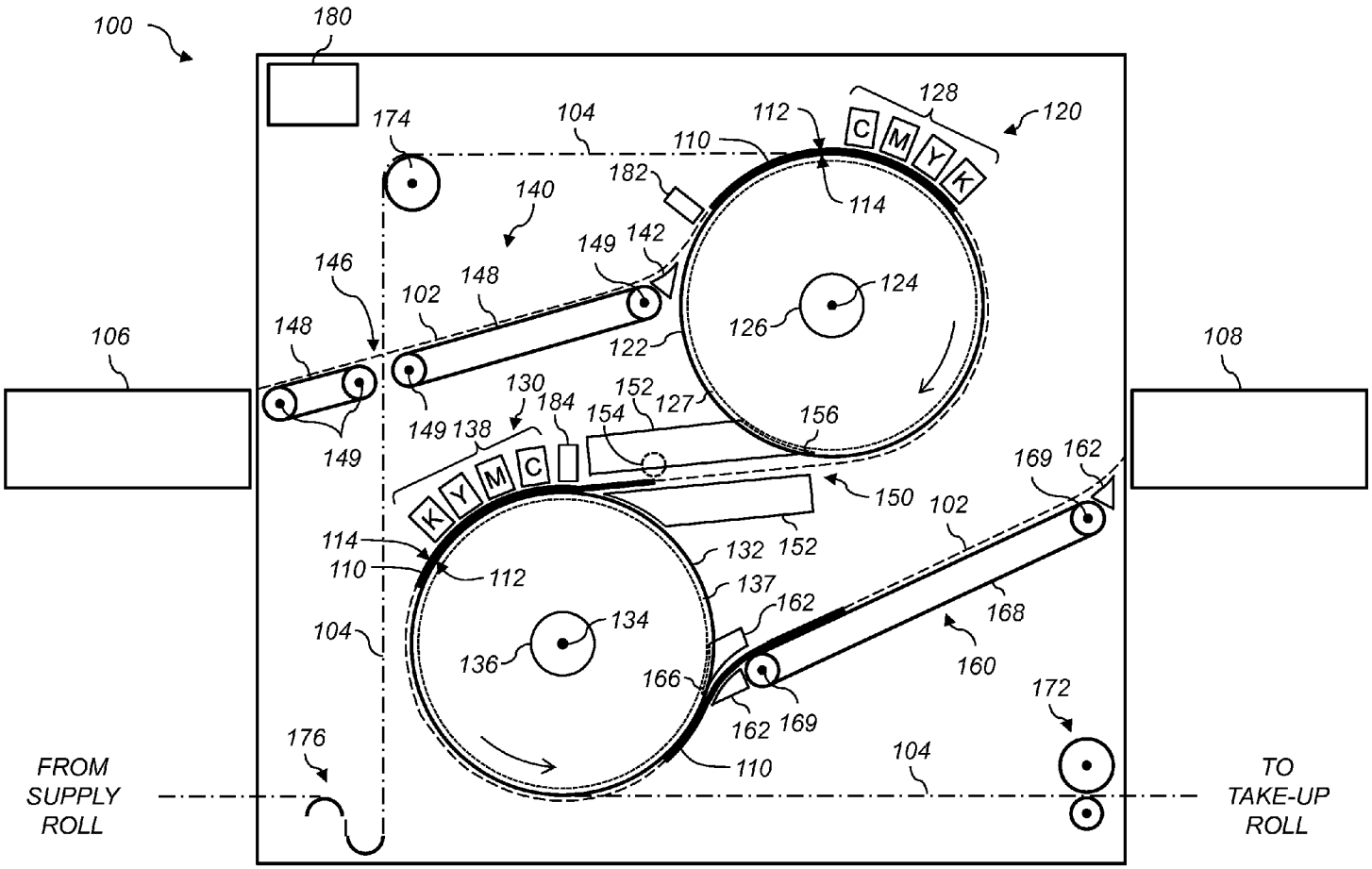
FIG. 4 is a schematic side view diagram showing a duplex printing system according to an alternate embodiment where the input and output sheet transport mechanisms include drive belts.

In the embodiment illustrated in FIGS. 1A-1B, the input sheet transport mechanism 140, the intermediate sheet transport mechanism 150 and the output sheet transport mechanism 160 all utilize passive sheet guides 142, 152, 162, together with drive rollers 144, 154, 164 to guide the sheets of media 110 along the sheet transport path 102. In other embodiments, some or all of these transport mechanisms can utilize other means for guiding the sheets of media 110. For example, FIG. 4 illustrates a configuration where the input sheet transport mechanism 140 and the output sheet transport mechanism 160 utilize motorized drive belt mechanisms to transport the sheets of media 110. In the illustrated embodiment, the input sheet transport mechanism 140 includes two drive belts 148, each of which is transported around a pair of rollers 149. Likewise, the output sheet transport mechanism 160 includes a drive belt 168 which is transported around a pair of rollers 169.

Generally, one or more of the rollers 149, 169 associated with each of the drive belts 148, 168 is a motor-driven roller that rotates to move the associated drive belt 148, 168 around a belt path. Preferably, the velocity that the drive belts 148, 168 are moved is equal to the tangential velocity of the surfaces of the print drums 122, 132 so that the sheet of media 110 can be handed off smoothly from one component to the next.

In some embodiments, the drive belts 148, 168 include a holding mechanism such as a vacuum holding mechanism or an electrostatic holding mechanism to hold the sheets of media 110 to the surface of the drive belts 148, 168. Such holding mechanisms are well-known in the media handling art.

In the embodiment illustrated in FIGS. 1A-1B, the tensioning system includes two tensioning mechanisms, each of which includes a pair of active tensioning rollers 170, 172. One skilled in the art will recognize that the tensioning system can utilize any technology known in the art to control the tension and the movement of the web of media 116. In some embodiments, the first tensioning mechanism near the start of the web transport path 104 is a passive tensioning mechanism and the second tensioning mechanism near the end of the web transport path 104 is an active tensioning mechanism. The embodiment illustrated in FIG. 4 uses a tensioning system of this type. In this case, the first set of tensioning rollers 170 (FIG. 1B) has been replaced with an s-wrap tensioning mechanism 176 where the web of media 116 slides around two shoes (or fixed rollers) in an s-shaped path. The servo-driven active tensioning rollers 172 pull the web of media 116 through the s-wrap tensioning mechanism 176 at a specified velocity. The friction between the web of media 116 and the surface of the shoes creates a drag force which adds tension to the web of media 116. One such s-wrap tensioning mechanism 176 that can be used in accordance with the present invention is described in commonly-assigned U.S. Patent Application Publication 2013/0287465, entitled "Automatically-adjusting web-media tensioning mechanism" to N. Turner et al., which is incorporated herein by reference.

Figure 5:
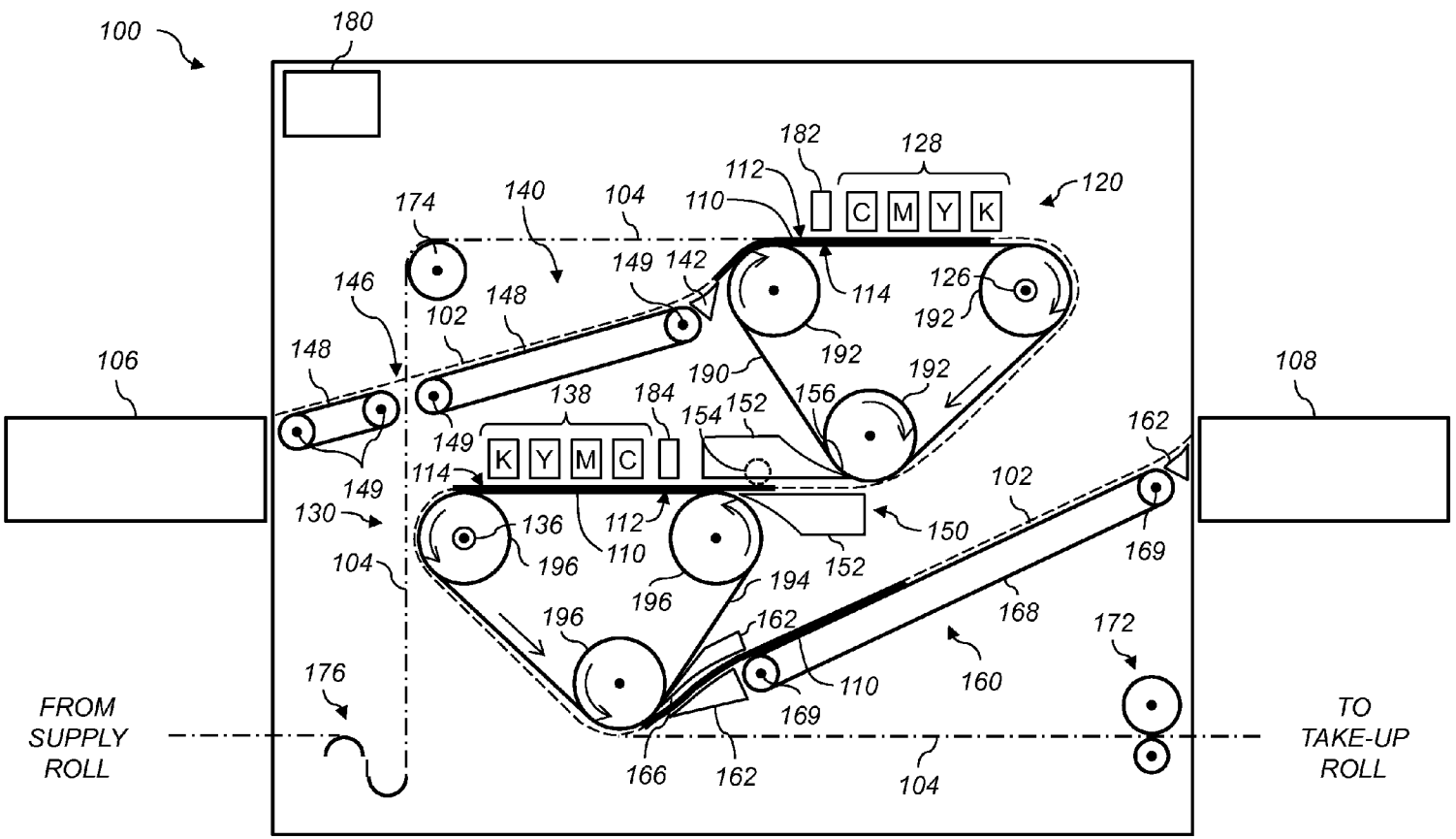
FIG. 5 is a schematic side view diagram showing a duplex printing system according to another alternate embodiment where print belts are used in place of the print drums of FIG. 4.

In the embodiment illustrated in FIGS. 1A-1B, the first and second printing stations 120, 130 each include a print drum 122, 132 which the media passes around while the marking subsystems 128, 138 are printing the image content on the corresponding side of the media. One skilled in the art will recognize that other types of mechanisms can be used to perform the same function as the print drums 122, 132. FIG. 5 illustrates an alternate embodiment which is analogous to the configuration of FIG. 4 except that the printing stations 120, 130 utilize continuous print belts 190, 194 rather than print drums 122, 132. The print belt 190 in the first printing station 120 passes around a plurality of rollers 192 in a continuous belt path. Likewise, the print belt 194 in the second printing station 130 passes around a plurality of rollers 196 in a continuous belt path.

When the printing system 100 is being used in the sheet-printing mode, the print belts 190, 194 are driven using corresponding drive mechanisms 126, 136. In an exemplary embodiment, the drive mechanisms 126, 136 are used to drive the rotation of one of the rollers 192, 196 in order to move the corresponding print belts 190, 194 around their respective belt paths.

The print belts 190, 194 preferably include a holding mechanism such as a vacuum holding mechanism or an electrostatic holding mechanism to hold the sheets of media 110 to the surface of the drive belts 148, 168. Such holding mechanisms are well-known in the media handling art. Generally, the holding mechanisms can be deactivated while the printing system 100 is being used in the web-printing mode.

In some embodiments, the intermediate sheet transport mechanism 150 and the output sheet transport mechanism 160 can include fingers 156, 166 which extend into grooves formed in the surface of the print belts 190, 194 to serve as stripping mechanisms to strip the sheets of media 110 away from the surface of the print belts 190, 194. In other embodiments, the print belts 190, 194 can include a series of separate belt bands separated by gaps, and the fingers 156, 166 can be aligned with the gaps between the belt bands.

Other than the use of the print belts 190, 194 rather than print drums 122, 132, the operation of the printing system 100 in the configuration of FIG. 5 is identical to that which was described earlier in great detail with respect to FIGS. 1A-1B. In summary, when the printing system is operating in the sheet-printing mode, sheets of media 110 are transported along sheet transport path 102 such that the sheets of media 110 are transported by the input sheet transport mechanism 140 from the input sheet feeder 106 to the first print belt 190. The control system 180 controls the first drive mechanism 126 to move the first print belt 190 around its belt path, thereby transporting the sheets of media 110 past the first marking subsystems 128 with the first side 112 of the sheets of media 110 facing the first marking subsystems 128 and the second side 114 of the sheets of media 110 being in contact with the first print belt 190. The sheets of media 110 are then transported by the intermediate sheet transport mechanism 150 from the first print belt 190 to the second print belt 194. The control system 180 controls the second drive mechanism 136 to move the second print belt 194 around its belt path, thereby transporting the sheets of media 110 past the second marking subsystems 138 with the second side 114 of the sheets of media 110 facing the second marking subsystems 138 and the first side 112 of the sheets of media 110 being in contact with the second print belt 194. The sheets of media 110 are then transported by the output sheet transport mechanism 160 from the second print belt 194 to the output sheet receptacle 108.

When the printing system 100 of FIG. 5 is operating in the web-printing mode, the first and second drive mechanisms 126, 136 are deactivated so that the print belts 190, 194 move freely around their respective belt paths, and the control system 180 controls the tensioning system to transport the web of media 116 (not shown in FIG. 5) along a web transport path 104 such that the web of media 116 travels from a first tensioning mechanism (e.g., s-wrap tensioning mechanism 176) to the first print belt 190. The web of media 116 passes around the first print belt 190 with the second side 114 of the web of media 110 being in contact with the first print belt 190, thereby transporting the web of media 110 past the first marking subsystems 128 with the first side 112 of the web of media 110 facing the first marking subsystems 128. The web of media 110 then travels from the first print belt 190 to the second print belt 194. The web of media 110 then passes around the second print belt 194 with the first side 112 of the web of media 116 being in contact with the second print belt 194, thereby transporting the web of media 116 past the second marking subsystems 138 with the second side 114 of the web of media 116 facing the second marking subsystems 138. The web of media 116 then travels from the second print belt 194 to the second tensioning mechanism (e.g., tensioning rollers 172) and exits the printing system 100.

Figure 6:
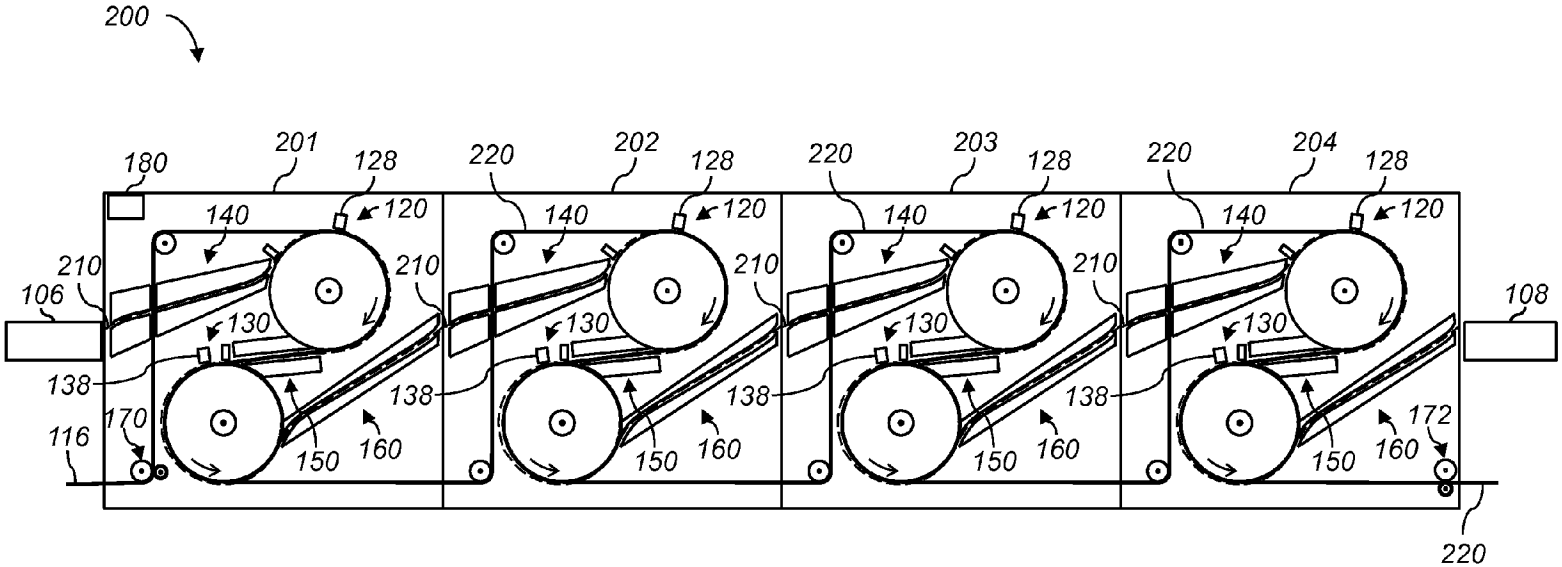
FIG. 6 is a schematic side view diagram showing a duplex printing system including a plurality of printing modules of the type shown in FIGS. 1A-1B.

FIG. 6 illustrates a printing system 200 that includes a plurality of printing modules 201, 202, 203, 204, each of which have a configuration analogous to that of FIGS. 1A-1B. In this case, when the printing system 200 is being operated in the web-printing mode, the web of media 116 passes through each printing module 201, 202, 203, 204 in succession along web transport path 220, with the output of the first printing module 201 being aligned with the input to the second printing module 202 and so forth. Similarly, when the printing system 200 is being operated in the sheet-printing mode, sheets of media 110 (not shown in FIG. 6) passes through each printing module 201, 202, 203, 204 in succession along sheet transport path 210, with the output of the first printing module 201 being aligned with the input to the second printing module 202 and so forth.

In the exemplary embodiment of FIG. 6, the printing stations 120, 130 in each of the printing modules 201, 202, 203, 204 is adapted to print a single color of marking material. For example the first printing module 201 can print cyan, the second printing module 202 can print magenta, the third printing module 203 can print yellow and the fourth printing module 204 can print black. This type of configuration can be useful where the marking subsystems 128, 138 may not be amenable to being positioned to closely together.

Figure 7A:
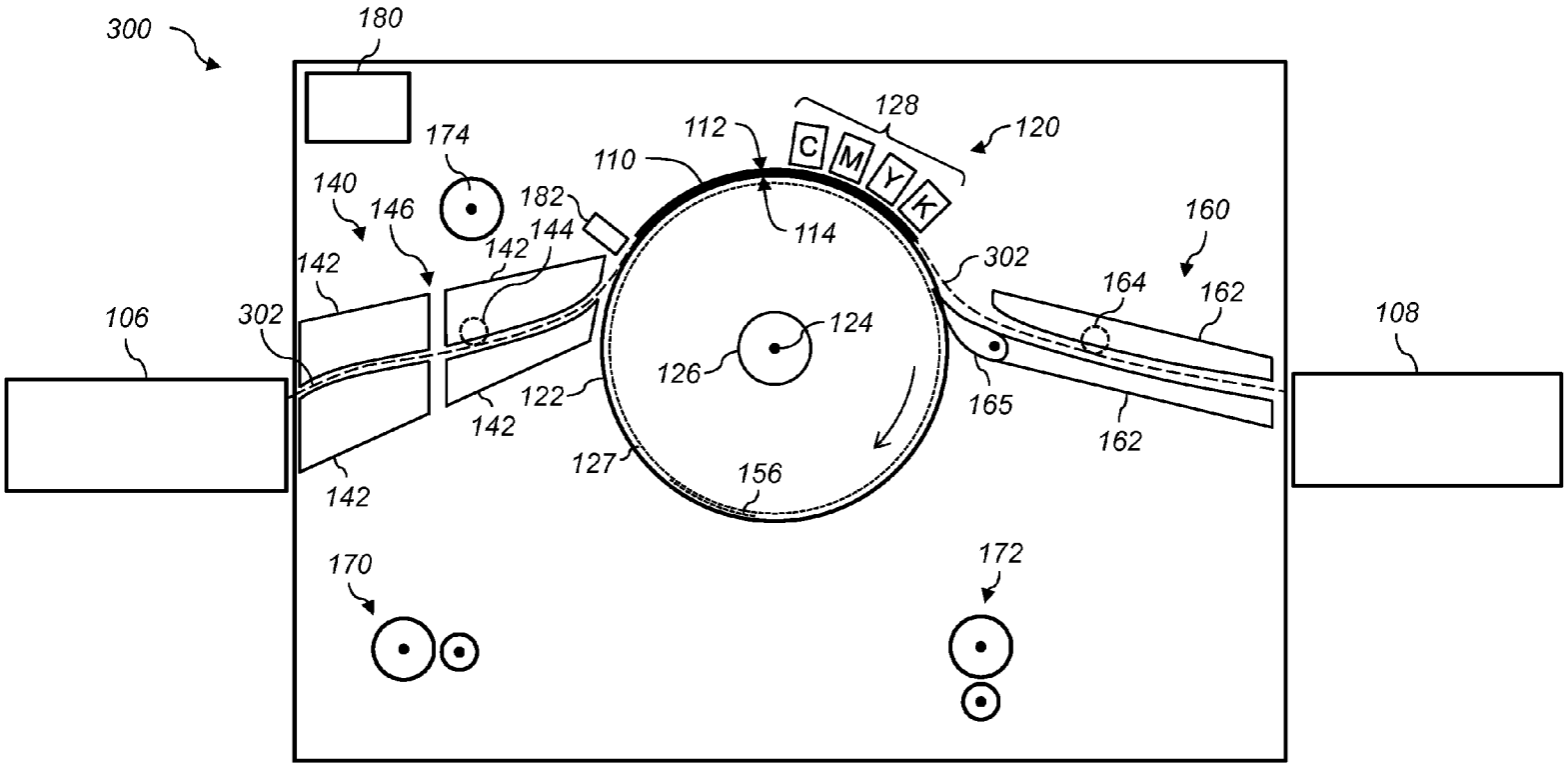
FIG. 7A is a schematic side view diagram showing a simplex printing system according to an exemplary embodiment being operated in a cut sheet printing mode.
Figure 7B:
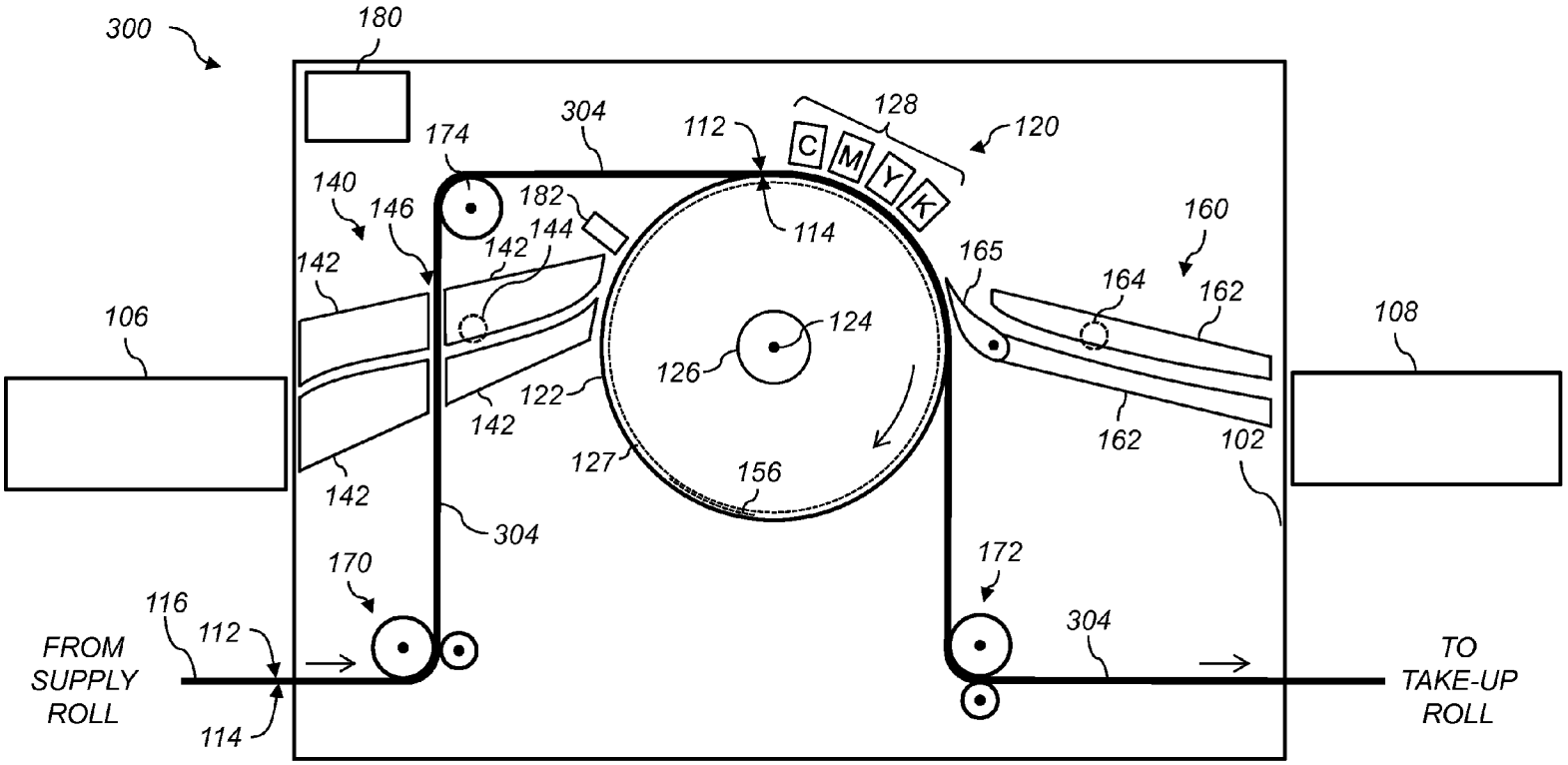
FIG. 7B is a schematic side view diagram showing the printing system of FIG. 7A being operated in a web printing mode.

The previously described embodiments have been directed to duplex printing systems that are adapted to print on both sides of the receiver medium. The basic features of the design can also be applied to simplex printers that only print on a single side of the receiver medium. FIGS. 7A-7B illustrate one such design for a simplex printing system 300 that can be operated in either a sheet-printing mode or a web-printing mode. In FIG. 7A, the printing system 300 is shown operating in the sheet-printing mode for printing on cut sheets of media 110. In FIG. 7B, the printing system 300 is shown operating in the web-printing mode for printing on a web of media 116. When the printing system 300 is operating in the web-printing mode, the web of media 116 travels along a web transport path 304 which does not interfere with the components used in the sheet-printing mode and when the printing system 300 is operating in the sheet-printing mode, the sheets of media 110 travel along a sheet transport path 302 which does not interfere with the components used in the web-printing mode.

The printing system 300 includes a single printing station 120 for printing on a first side of the media. The printing station 120 is analogous to that shown in the configuration of FIGS. 1A-1B and includes a print drum 122, and a set of first marking subsystems 128 positioned to deposit a pattern of marking material on the first side 112 of the media according to first-side image content while the second side 114 of the media is in contact with the print drum 122. A selectively activatable first drive mechanism 126 is used to drive the print drum 122 to rotate around a corresponding axis 124. Generally, the print drum 122 will include a holding subsystem (e.g., a vacuum holding mechanism or an electrostatic holding mechanism) to hold the sheets of media 110 firmly onto the print drum 122 as they are transported past the marking subsystems 128.

In some embodiments, the print drum 122 in the printing station 120 can be replaced with a print belt 190 analogous to that described previously with respect to FIG. 5. The generalized terminology "print member" can be used to refer to either the print drum 122 or the print belt 190, or to any other type of mechanism for transporting the sheets of media 110 and the web of media 116 past the marking subsystems. Both the print drum 122 and the print belt 190 can be considered to be "rotatable," with the print drum 122 rotating around its axis 124 and the print belt 190 "rotating" around its belt path.

In the illustrated embodiment, the marking subsystems 128 are used to apply cyan (C), magenta (M), yellow (Y) and black (K) marking materials. In other embodiments, the marking subsystems 128 can apply a different set of marking materials which can include different colors of marking materials or colorless marking materials.

In an exemplary embodiment, the marking subsystems 128 are inkjet printheads adapted to apply drops of ink to the receiver media. The inkjet printheads can be of drop-on-demand inkjet printheads or the continuous inkjet printheads. Both types of printheads will be well-known to those skilled in the art. In other embodiments, the marking subsystems 128 can utilize other types of printing technology such as electrophotographic printing or thermal dye sublimation printing.

When the printing system 300 is operated in the first sheet-printing mode, a series of components are used to move sheets of media 110 along a sheet transport path 302 as illustrated in FIG. 7A.

An input sheet feeder 106 is provided to supply sheets of media 110 to the printing system 300, and an output sheet receptacle 108 is provided to receive sheets of media 110 that have been printed using the printing system 300.

An input sheet transport mechanism 140 is provided for transporting sheets of media 110 from the input sheet feeder 106 to the print drum 122. In the illustrated embodiment, the input sheet transport mechanism 140 includes a set of passive sheet guides 142 which guide the sheets of media 110 along the sheet transport path 302. The input sheet transport mechanism 140 optionally includes a motorized drive mechanism, such as drive roller 144, for actively moving the sheets of media 110 along the sheet transport path 302. A slot 146 is provided through input sheet transport mechanism 140 which enables the web of media 116 to pass through the input sheet transport mechanism 140 as it travels along the web transport path 304 (see FIG. 7B).

An output sheet transport mechanism 160 is adapted to transport the sheets of media 110 from the print drum 122 to the output sheet receptacle 108. In the illustrated embodiment, the output sheet transport mechanism 160 includes a pair of passive sheet guides 162 and a motorized drive roller 164 for moving the sheets of media 110 along the sheet transport path 302.

Preferably, a sheet stripping mechanism is provided to strip the sheets of media 110 away from the surface of the print drum 122 to direct them along the sheet transport path 302. Any appropriate type of sheet stripping mechanism known in the art can be used in accordance with the present invention. In the illustrated embodiment, a set of pivotable fingers 165 are attached to the lower sheet guide 162 in the output sheet transport mechanism 160. When the pivotable fingers 165 are pivoted to a first position as shown in FIG. 7A, they extend into grooves 127 formed around the surface of the print drum 122. As a sheet of media 110 is carried along the sheet transport path 302 by the print drum 122, the pivotable fingers 165 will lift the leading edge of the sheet of media 110 away from the surface of the print drum 122, and will direct the sheet of media 110 between the sheet guides 162 of the output sheet transport mechanism 160. When the printing system is being operated in the web-printing mode, the pivotable fingers 165 can be pivoted to a second position where they do not interfere with the web transport path 304 as illustrated in FIG. 7B. In alternate embodiments, other types of sheet stripping mechanisms can be used. For example, air knives can be directed to lift the sheets of media 110 away from the surface of the print drum 122.

When the printing system 300 is operated in the second web-printing mode, a series of components are used to move the web of media 116 along the web transport path 304 as illustrated in FIG. 7B. A tensioning system is used for driving and adding tension to the web of media 116. In the illustrated embodiment, the tensioning system includes tensioning rollers 170, 172. The web of media 116 is supplied by a supply roll (not shown) and passes between the first set of tensioning rollers 170, which adds tension to the web of media 116 and redirects it in a vertical direction. The web of media 116 then passes around an encoder roller 174 which redirects it toward the print drum 122. After passing around the print drum 122, the web of media travels to the second set of tensioning rollers 172 and is received by a take-up roll or appropriate finishing components (not shown). In some embodiments, the first set of tensioning rollers 170 can be replaced with a passive s-wrap tensioning mechanism 176 as was discussed previously with respect to FIG. 4.

A control system 180 is provided to control the components of the printing system 300. Among other things, the control system 180 can control the drive mechanism 126 to rotate the print drum 122. The control system 180 also controls the components of the tensioning system (e.g., the tensioning rollers 170, 172) to control the amount of tension in the web of media 116, and the velocity that the web of media 116 travels through the printing system 300. The control system 180 also controls the marking subsystems 128 to control the pattern of marking material deposited on the media in accordance with image data. The control system 180 also controls other active components such as the input sheet feeder 106, the output sheet receptacle 108 and the drive rollers 144, 164.

The printing system also includes one or more position encoder subsystems that provide encoder signals providing an indication of the position of the sheets of media 110 as they travel along the sheet transport path 302 or the web of media 116 as it travels along the web transport path 304. The encoder signals can be used to control a timing that the marking subsystems 128 deposit the pattern of marking material on the media. In the illustrated embodiment, a media edge detector 182 serves the role of the position encoder subsystem in the sheet-printing mode, and encoder roller 174 serves the role of the position encoder subsystem in the web-printing mode. These components function in an analogous manner to that described earlier with references to FIGS. 1A-1B.

The operation of the printing system 300 in the two printing modes will now be described. When the printing system 300 is operating in the first sheet-printing mode, sheets of media 110 are transported through the printing system 300 along the sheet transport path 302. The sheets of media 110 are supplied from the input sheet feeder 106 and are carried by the input sheet transport mechanism 140 to the print drum 122. The control system 180 controls the drive mechanism 126 associated with the print drum 122 to rotate the print drum 122, thereby transporting the sheets of media 110 past the marking subsystems 128. The sheets of media 110 will be oriented so that the second side 114 contacts the print drum 122 and the first side 112 faces the marking subsystems 128. This enables the marking subsystems 128 to print the image content on the first side 112 of the media in accordance with image data provided to the printing system 100. In an exemplary embodiment, the timing that the marking subsystems 128 deposit marking material onto the sheet of media 110 is controlled responsive to a signal from the media edge detector 182, which determines a position of the sheet of media 110 on the print drum 122.

After the printing station 120 has printed the image data on the first side 112 of the sheet of media 110, it is directed into the output sheet transport mechanism 160, which transports the sheet of media 110 to the output sheet receptacle 108. In the illustrated embodiment, the drive roller 164 in the output sheet transport mechanism 160 pushes the sheet of media 110 through the output sheet transport mechanism 160 and propels it until the sheet of media 110 reaches the output sheet receptacle 108.

The printing system 300 can also be configured to operate in a second web-printing mode to print on a web of media 116 as illustrated in FIG. 7B. In this mode, the web of media 116 is threaded through the printing system 300 to travel along the web transport path 304. To switch the printing system 300 from the sheet-printing mode to the web-printing mode, it is generally necessary to make a number of adjustments to the printer components. In particular, the drive mechanism 126 associated with the print drum 122 should be deactivated so that the print drum 122 can rotate freely. As was discussed earlier, this typically involves turning off the motor and making either manual or automatic adjustments to decouple the motor from the print drum 122 (e.g., by repositioning a gear or a clutch mechanism). Also, the pivotable fingers 165 are pivoted upward so that they do not interfere with the web transport path 304. In some embodiments, an automatic mechanism can be provided to pivot the pivotable fingers 165. In other embodiments, this operation can be performed manually by an operator.

In the web-printing mode, the control system 180 controls the tensioning system to transport the web of media 116 along the web transport path 304 at a controlled tension and velocity. In an exemplary embodiment, this can be done by controlling the speed of servo-driven motors used to drive the tensioning rollers 170, 172. It will generally be desirable for the control system 180 to deactivate the tensioning rollers 170, 172 when the printing system 300 is being operated in the sheet-printing mode to conserve energy and reduce component wear.

The web transport path 304 carries the web of media 116 from a supply roll (not shown) into the printing system 300 and through the first set of tensioning rollers 170. The web of media 116 then travels upward through a slot 146 in the input sheet transport mechanism 140 and passes around the encoder roller 174. From there it travels to the print drum 122 with the second side 114 of the web of media 116 being in contact with the surface of the print drum 122.

As the web of media 116 travels around the print drum 122, the marking subsystems 128 deposit marking material to print the image content on the first side 112 of the web of media 116 in accordance with image data provided to the printing system 100. In an exemplary embodiment, the timing that the marking subsystems 128 deposit marking material onto the web of media 116 is controlled responsive to a signal from the encoder roller 174, which characterizes the movement and position of the web of media 116.

The web of media 116 then travels from the print drum 122 through the second set of tensioning rollers 172. From there, the web of media 116 typically travels to a take-up roll (not shown). In some embodiments, the web of media 116 can travel to various finishing components which can perform operations such as slitting, cutting, folding and binding the media to deliver the printed image into a format requested by the customer.

In the embodiment illustrated in FIGS. 7A-7B, the input sheet transport mechanism 140 and the output sheet transport mechanism 160 utilize passive sheet guides 142, 162, together with drive rollers 144, 164 to guide the sheets of media 110 along the sheet transport path 302. In other embodiments, some or all of these transport mechanisms can utilize other means for guiding the sheets of media 110. For motorized drive belt mechanisms can be used as was illustrated in the embodiment of FIG. 4.

In some embodiments, a plurality of printing modules having the form of the printing system 300 can be chained together to provide an extended capability in a manner which is analogous to the configuration which was described previously with respect to FIG. 6.

The invention has been described in detail with particular reference to certain preferred embodiments thereof, but it will be understood that variations and modifications can be effected within the spirit and scope of the invention.

PARTS LIST

100 printing system
102 sheet transport path
104 web transport path
106 input sheet feeder
108 output sheet receptacle
110 sheet of media
112 first side
114 second side
116 web of media
120 printing station
122 print drum
123 channel
124 axis
125 leading edge region
126 drive mechanism
127 groove
128 marking subsystems
129 vacuum hole
130 printing station
132 print drum
134 axis
136 drive mechanism
137 groove
138 marking subsystems
140 input sheet transport mechanism
142 sheet guide
144 drive roller
146 slot
148 drive belt
149 roller
150 intermediate sheet transport mechanism
152 sheet guide
154 drive roller
156 fingers
160 output sheet transport mechanism
162 sheet guide
164 drive roller
165 pivotable fingers
166 fingers
168 drive belt
169 roller
170 tensioning rollers
172 tensioning rollers
174 encoder roller
176 s-wrap tensioning mechanism
180 control system
182 media edge detector
184 media edge detector
190 print belt
192 roller
194 print belt
196 roller
200 printing system
201 printing module
202 printing module

203 printing module
204 printing module
210 sheet transport path
220 web transport path
300 printing system
302 sheet transport path
304 web transport path

The invention claimed is:

1. A duplex printing system for printing on sheets of media in a first printing mode and on a web of media in a second printing mode, comprising:

a first printing station including a first print belt and one or more first marking subsystems positioned to deposit a pattern of marking material on a first side of the media while a second side of the media is in contact with the first print belt, wherein the first print belt travels around a plurality of rollers in a continuous first belt path;

a selectively activatable first drive mechanism for moving the first print belt around the first belt path;

a second printing station including a second print belt and one or more second marking subsystems positioned to deposit a pattern of marking material on the second side of the media while the first side of the media is in contact with the second print belt, wherein the second print belt travels around a plurality of rollers in a continuous second belt path;

a selectively activatable second drive mechanism for moving the second print belt around the second belt path;

a tensioning system for driving and adding tension to the web of media; and a control system for controlling the first and second drive mechanisms and the tensioning system;

wherein when the duplex printing system is in the first printing mode sheets of media are transported along a sheet transport path such that:

the sheets of media are transported to the first print belt;

the control system controls the first drive mechanism to move the first print belt around the first belt path, thereby transporting the sheets of media past the one or more first marking subsystems to deposit a pattern of marking material on the first side of the sheets of media in accordance with image data;

the sheets of media are transported from the first print belt to the second print belt;

the control system controls the second drive mechanism to move the second print belt around the second belt path, thereby transporting the sheets of media past the one or more second marking subsystems to deposit a pattern of marking material on the second side of the sheets of media in accordance with image data; and the sheets of media are transported from the second print belt to an output of the duplex printing system; and when the duplex printing system is in the second printing mode the first and second drive mechanisms are deactivated so that the first and second print belts can move freely around their respective first and second belt paths, and the control system controls the tensioning system to transport the web of media along a web transport path such that:

the web of media travels to the first print belt;

the web of media passes around the first print belt with the second side of the web of media being in contact with the first print belt, thereby transporting the web of media past the one or more first marking subsystems to deposit a pattern of marking material on the first side of the web of media in accordance with image data;

the web of media travels from the first print belt to the second print belt;

the web of media passes around the second print belt with the first side of the web of media being in contact with the second print belt, thereby transporting the web of media past the one or more second marking subsystems to deposit a pattern of marking material on the second side of the web of media in accordance with image data; and the web of media travels from the second print belt to an output of the duplex printing system.

2. The duplex printing system of claim 1 wherein the tensioning system includes a first tensioning mechanism positioned along the web transport path before the first drum and a second tensioning mechanism positioned along the web transport path after the second drum.

3. The duplex printing system of claim 2 wherein one or both of the first and second tensioning mechanisms is a set of tensioning rollers.

4. The duplex printing system of claim 2 wherein the first tensioning mechanism is passive tensioning mechanism and the second tensioning mechanism is an active tensioning mechanism.

5. The duplex printing system of claim 4 wherein when the duplex printing system is in the first printing mode, the control system deactivates the active tensioning mechanism.

6. The duplex printing system of claim 4 wherein when the active tensioning mechanism includes a servo-driven tensioning roller.

7. The duplex printing system of claim 1 wherein when the duplex printing system is in the first printing mode a first holding subsystem is used to hold the sheets of media to the first print belt and a second holding subsystem is used to hold the sheets of media to the second print belt.

8. The duplex printing system of claim 7 wherein the control system controls the first and second holding subsystems such that:

the first holding subsystem is activated while a particular sheet of media is being transported past the first marking subsystems;

the first holding subsystem is deactivated to release the particular sheet of media from being held to the first print belt in synchronization with activating the second holding subsystem to hold the particular sheet of media to the second print belt; and the second holding subsystem remains activated while the particular sheet of media is being transported past the second marking subsystems.

9. The duplex printing system of claim 7 wherein one or both of the first and second holding subsystems include a vacuum holding mechanism or an electrostatic holding mechanism.

10. The duplex printing system of claim 1 further including:

an input sheet feeder adapted to supply sheets of media;

an output sheet receptacle for receiving sheets of media;

an input sheet transport mechanism adapted to transport sheets of media from the input sheet feeder to the first print belt;

an intermediate sheet transport mechanism adapted to transport sheets of media from the first print belt to the second print belt; and an output sheet transport mechanism adapted to transport sheets of media from the second print belt to the output sheet receptacle.

11. The duplex printing system of claim 10 wherein the web transport path transports the web of media through a slot in the input sheet transport mechanism.

12. The duplex printing system of claim 10 further including:

a first sheet stripping mechanism to strip the sheets of media away from the surface of the first print belt and direct them into the intermediate sheet transport mechanism; and a second sheet stripping mechanism to strip the sheets of media away from the surface of the second print belt and direct them into the output sheet transport mechanism.

13. The duplex printing system of claim 12 wherein at least one of the sheet stripping mechanisms includes a plurality of fingers that extend into grooves formed around the surface of the corresponding print belt, the fingers being adapted to lift the sheets of media away from the surface of the corresponding print belt.

14. The duplex printing system of claim 12 wherein at least one of the print belts includes a series of separate belt bands which travel around the corresponding belt path, the belt bands being separated by gaps, and wherein at least one of the sheet stripping mechanisms includes a plurality of fingers that extend into gaps between the belt bands, the fingers being adapted to lift the sheets of media away from the surface of the corresponding print belt.

15. The duplex printing system of claim 12 wherein at least one of the sheet stripping mechanisms includes an air knife directed to lift the sheets of media away from the surface of the corresponding print belt.

16. The duplex printing system of claim 10 wherein one or more of the input sheet transport mechanism, the intermediate sheet transport mechanism and the output sheet transport mechanism includes one or more passive sheet guides which guide the sheets of media along the sheet transport path.

17. The duplex printing system of claim 16 wherein the web transport path transports the web of media between two passive sheet guides in the intermediate sheet transport mechanism without touching the two passive sheet guides.

18. The duplex printing system of claim 10 wherein one or more of the input sheet transport mechanism, the intermediate sheet transport mechanism and the output sheet transport mechanism includes a motorized drive mechanism that actively moves the sheets of media along the sheet transport path.

19. The duplex printing system of claim 18 wherein the motorized drive mechanism includes a motorized drive belt or a motorized drive roller.

20. The duplex printing system of claim 1 further including a position encoder subsystem that provides an encoder signal providing an indication of a position of the media as it travels along the sheet transport path or the web transport path, wherein a timing that the marking subsystems deposit the pattern of marking material onto the media is controlled responsive to the encoder signal.

21. The duplex printing system of claim 20 wherein the position encoder subsystem includes one or more media edge detectors that detect a position of one or more edges of the sheets of media when the duplex printing system is in the first printing mode.

22. The duplex printing system of claim 20 wherein the position encoder subsystem includes an encoder roller around which the web of media passes when the duplex printing system is in the second printing mode.

23. The duplex printing system of claim 1 wherein the first and second marking subsystems are inkjet marking subsystems.

24. A duplex printing system for printing on sheets of media in a first printing mode and on a web of media in a second printing mode, comprising:

a plurality of printing modules, each including:

a first printing station including a first print belt and one or more first marking subsystems positioned to deposit a pattern of marking material on a first side of the media while a second side of the media is in contact with the first print belt, wherein the first print belt travels around a plurality of rollers in a continuous first belt path;

a selectively activatable first drive mechanism for moving the first print belt around the first belt bath;

a second printing station including a second print belt and one or more second marking subsystems positioned to deposit a pattern of marking material on the second side of the media while the first side of the media is in contact with the second print belt, wherein the second print belt travels around a plurality of rollers in a continuous second belt path;

a selectively activatable second drive mechanism for moving the second print belt around the second belt path;

a tensioning system for driving and adding tension to the web of media; and a control system for controlling the first and second drive mechanisms in the plurality of printing modules and the tensioning system;

wherein when the duplex printing system is in the first printing mode sheets of media are transported along a sheet transport path through each printing module in succession such that in each printing module:

the sheets of media are transported from an input of the printing module to the first print belt;

the control system controls the first drive mechanism to move the first print belt around the first belt path, thereby transporting the sheets of media past the one or more first marking subsystems to deposit a pattern of marking material on the first side of the sheets of media in accordance with image data;

the sheets of media are transported from the first print belt to the second print belt;

the control system controls the second drive mechanism to move the second print belt around the second belt path, thereby transporting the sheets of media past the one or more second marking subsystems to deposit a pattern of marking material on the second side of the sheets of media in accordance with image data; and the sheets of media are transported from the second print belt to an output of the printing module; and when the duplex printing system is in the second printing mode the first and second drive mechanisms in each printing module are deactivated so that the first and second print belts move freely around their respective first and second belt paths, and the control system controls the tensioning system to transport the web of media along a web transport path through each printing module in succession such that in each printing module:

the web of media passes travels from an input to the printing module to the first print belt;

the web of media passes around the first print belt with the second side of the web of media being in contact with the first print belt, thereby transporting the web of media past the one or more first marking subsystems to deposit a pattern of marking material on the first side of the web of media in accordance with image data;

the web of media travels from the first print belt to the second print belt;

the web of media passes around the second print belt with the first side of the web of media being in contact with the second print belt, thereby transporting the web of media past the one or more second marking subsystems to deposit a pattern of marking material on the second side of the web of media in accordance with image data; and the web of media travels from the second print belt to an output of the printing module;

wherein the printing modules are arranged in a sequence such that the output of one printing module is aligned with the input of a subsequent printing module.

* * * * *